US008056146B2

(12) United States Patent
Porowski

(10) Patent No.: US 8,056,146 B2
(45) Date of Patent: Nov. 15, 2011

(54) DISPOSABLE ISOLATION HOSPITAL GOWN

(76) Inventor: Virginia Porowski, Raleigh, NC (US)

( * ) Notice: Subject to any disclaimer, the term of this patent is extended or adjusted under 35 U.S.C. 154(b) by 163 days.

(21) Appl. No.: 12/533,383

(22) Filed: Jul. 31, 2009

(65) Prior Publication Data

US 2011/0023210 A1 Feb. 3, 2011

(51) Int. Cl.
*A41D 13/12* (2006.01)

(52) U.S. Cl. ..... 2/51; 2/901; 2/247

(58) Field of Classification Search ..... 2/247, 901, 2/69, 94, 52, 85, 87, 114
See application file for complete search history.

(56) References Cited

U.S. PATENT DOCUMENTS

| | | | | | |
|---|---|---|---|---|---|
| 2,143,931 | A | * | 1/1939 | Aronson | 2/93 |
| 2,292,347 | A | * | 8/1942 | Bailey | 2/93 |
| 2,324,722 | A | * | 7/1943 | Papierniak | 2/93 |
| 2,325,494 | A | * | 7/1943 | Fayer | 2/93 |
| 2,513,074 | A | * | 6/1950 | Wolfe | 2/84 |
| 2,668,294 | A | | 2/1954 | Gilpin | |
| 2,825,902 | A | * | 3/1958 | Breier | 2/93 |
| 2,959,789 | A | * | 11/1960 | Mills et al. | 2/93 |
| 2,971,198 | A | * | 2/1961 | Tomich | 2/84 |
| 3,085,254 | A | * | 4/1963 | Cutler | 2/243.1 |
| 3,451,062 | A | | 6/1969 | Bradley | |
| 3,745,587 | A | | 7/1973 | Bradley | |
| 4,064,562 | A | * | 12/1977 | Kenny | 2/84 |
| 4,404,689 | A | * | 9/1983 | DeWan | 2/247 |
| 4,476,587 | A | * | 10/1984 | Itoi | 2/94 |
| D277,048 | S | * | 1/1985 | Peyser | D2/831 |
| D277,049 | S | * | 1/1985 | Peyser | D2/831 |
| 4,608,719 | A | | 9/1986 | Lunt | |
| 4,700,409 | A | * | 10/1987 | De Lott | 2/94 |
| 4,819,275 | A | | 4/1989 | Lunt | |
| 4,845,779 | A | | 7/1989 | Wheeler et al. | |
| 4,944,042 | A | * | 7/1990 | DeWan | 2/94 |
| 5,010,592 | A | * | 4/1991 | Skiles, Jr. | 2/93 |
| 5,048,123 | A | * | 9/1991 | Monson | 2/69 |
| 5,410,758 | A | * | 5/1995 | Dupont et al. | 2/51 |
| 5,483,701 | A | * | 1/1996 | Ferreyros | 2/49.2 |
| 5,584,077 | A | * | 12/1996 | Thrift | 2/239 |
| 5,699,560 | A | * | 12/1997 | Greenberg | 2/94 |
| 6,742,189 | B2 | * | 6/2004 | Bennett | 2/49.2 |
| 6,817,031 | B1 | * | 11/2004 | Gravlin | 2/67 |
| 7,143,450 | B2 | * | 12/2006 | Green, III | 2/94 |
| 7,269,855 | B2 | * | 9/2007 | LaRocco | 2/49.1 |
| 7,395,555 | B2 | * | 7/2008 | Aldridge et al. | 2/69 |
| 2009/0031474 | A1 | | 2/2009 | Komorowski | |

* cited by examiner

*Primary Examiner* — Larry Worrell, Jr.
(74) *Attorney, Agent, or Firm* — Coats & Bennett, P.L.L.C.

(57) ABSTRACT

A disposable isolation hospital gown is provided having a main body and a pair of sleeves. Integrally formed with the hospital gown is a disposable wrapper that is particularly positioned or placed such that the gown can be rolled or folded into a bundle, after which the disposable wrapper is reversed and in the process of reversing the disposable wrapper, the bundled gown is stuffed or placed into the reversed disposable wrapper for disposal.

5 Claims, 4 Drawing Sheets

DISPOSABLE ISOLATION HOSPITAL GOWN

FIELD OF THE INVENTION

The present invention relates to gowns, and more particularly to a disposable isolation hospital gown.

BACKGROUND OF THE INVENTION

Isolation hospital gowns are well known. They are worn by doctors, nurses, other healthcare providers, hospital workers and visitors in hospitals and healthcare facilities in the course of treating or handling patients with serious contagious diseases, infections, potential infections or compromised immune systems. One of the concerns with isolation hospital gowns is that the removal of a gown from a person will spread germs, bacteria and other infections that might affect the person wearing the gown or other people in and around the gown and carried to later infect others the individuals come in contact with. Generally, no matter how much care is exercised in the conventional handling of an isolation hospital gown, there is a chance that contamination found on the exterior of the gown will spread.

There has been and continues to be a need for a disposable isolation hospital gown that can be discarded and disposed of in such a fashion that substantial risk of spreading contamination, infections, etc. is avoided.

SUMMARY OF THE INVENTION

The present invention is a disposable isolation hospital gown that includes an integral one or two part disposable wrapper. Once the gown has been used or exposed to infection or contamination, the hospital gown is rolled or folded into a bundle and wrapped in the integral disposable wrapper.

The present invention also entails a method of disposing of an isolation hospital gown by folding or rolling the hospital gown into a bundle and reversing an integral disposable wrapper that forms a part of the gown and wherein in the process of reversing the disposable wrapper, the bundled gown is placed or stuffed in the reversed disposable wrapper.

Other objects and advantages of the present invention will become apparent and obvious from a study of the following description and the accompanying drawings which are merely illustrative of such invention.

DESCRIPTION OF EXEMPLARY EMBODIMENT

Figure 1:
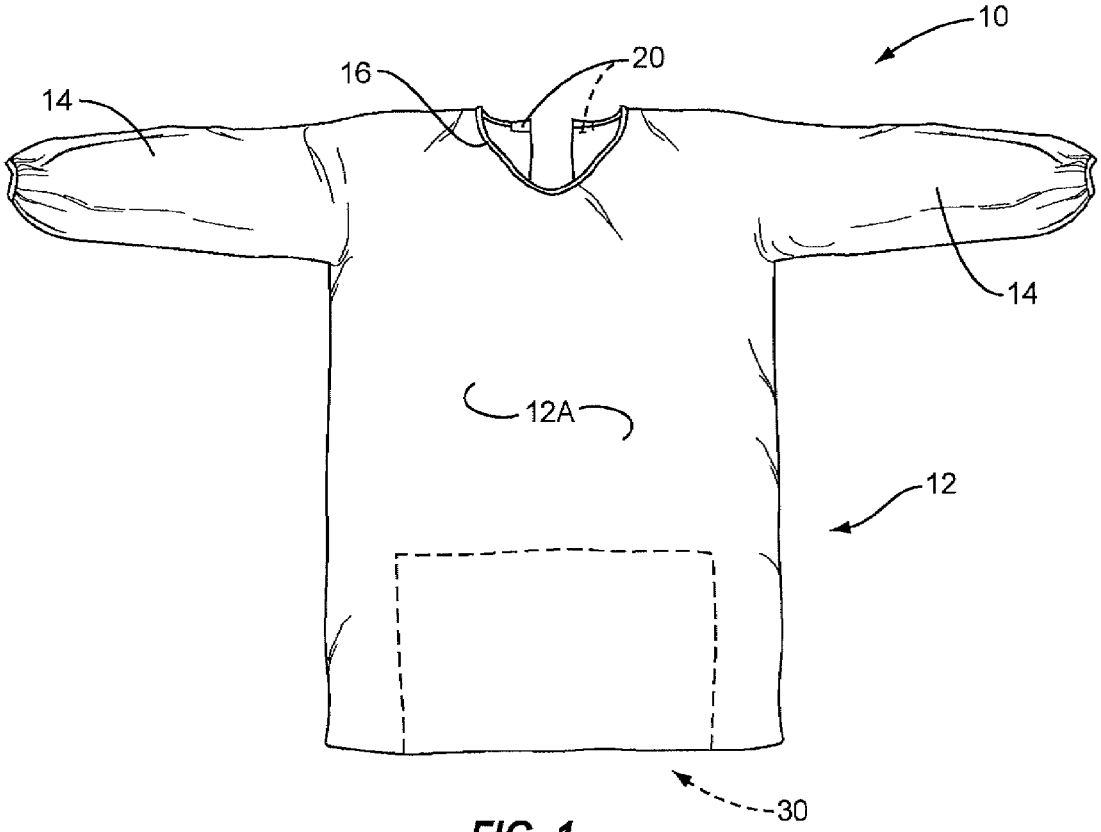
FIG. 1 is a front elevational view of the isolation hospital gown of the present invention.
Figure 2:
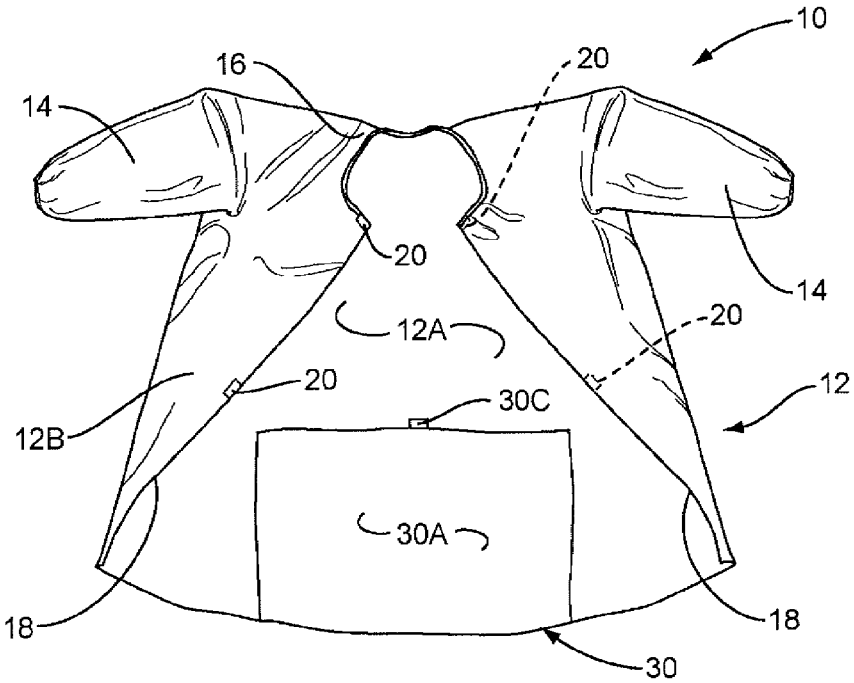
FIG. 2 is a rear elevational view of the hospital gown with the back thereof being open to illustrate a disposable wrapper integral with the gown.

With further reference to the drawings, an isolation hospital gown is shown therein and indicated generally by the numeral 10. Hospital gown 10 can be constructed of various materials such as conventional materials that are typically used in the construction of hospital gowns, especially isolation hospital gowns that are exposed to contamination. Hospital gown 10 includes a main body indicated generally by the numeral 12 and a pair of long sleeves 14 that project from the upper portion of the main body. Main body 12 includes two basic areas, a front area 12A and a back area 12B. Front area 12A is particularly shown in FIG. 1 and the back area is shown in FIG. 2. Back area 12B is split and includes terminal edges 18. This is illustrated in FIG. 2 and enables the gown 10 to be easily placed on and taken off a person. It is appreciated that the main body 12 includes an outer surface and an inner surface. In FIG. 1, the outer surface of front area 12*a* is shown. In FIG. 2, the outer surface of the back 12B is shown. Also in FIG. 2, the inner surface of the front area 12A is shown.

Continuing to refer to the gown 10, there is provided a neck opening 16 that extends around an upper portion of the main body 12. Further, adjacent the edges 18 of the back area 12B, there is provided one or more fasteners for securing the back area portions together when the gown 10 is worn by a person.

Gown 10 includes an integral disposable wrapper indicated generally by the numeral 30. Disposable wrapper 30 is secured to and forms a part of the gown 10. Note in the preferred embodiment the particular location of the disposable wrapper 30. It is placed about the lower portion of the front area 12A. As illustrated in FIGS. 1 and 2, the disposable wrapper 30 is generally centrally located with respect to the side edges of the front area 12A. That is, the disposable wrapper 30 is generally aligned with the neck opening 16. Also as seen in FIGS. 1 and 2, the disposable wrapper is disposed on the inside of the front area 12A.

Disposable wrapper 30 is pliable, non-permeable, and in one embodiment is comprised at least in part of plastic material. Disposable wrapper 30 can be secured or integrated into the gown 10 in various ways. For example, the disposable wrapper 30 can be glued or stitched into the gown 10. In one embodiment, a portion of the front area 12A can also serve as a side or surface of the disposable wrapper 30.

Secured to the side or panel 30A of wrapper 30 is a tab 30C. Tab 30C can be utilized to maintain the disposable wrapper 30 closed while the gown 10 is worn. In addition, and as discussed hereafter, tab 30C is utilized to close the disposable wrapper when the gown 10 has been wrapped therein.

Figure 3A:
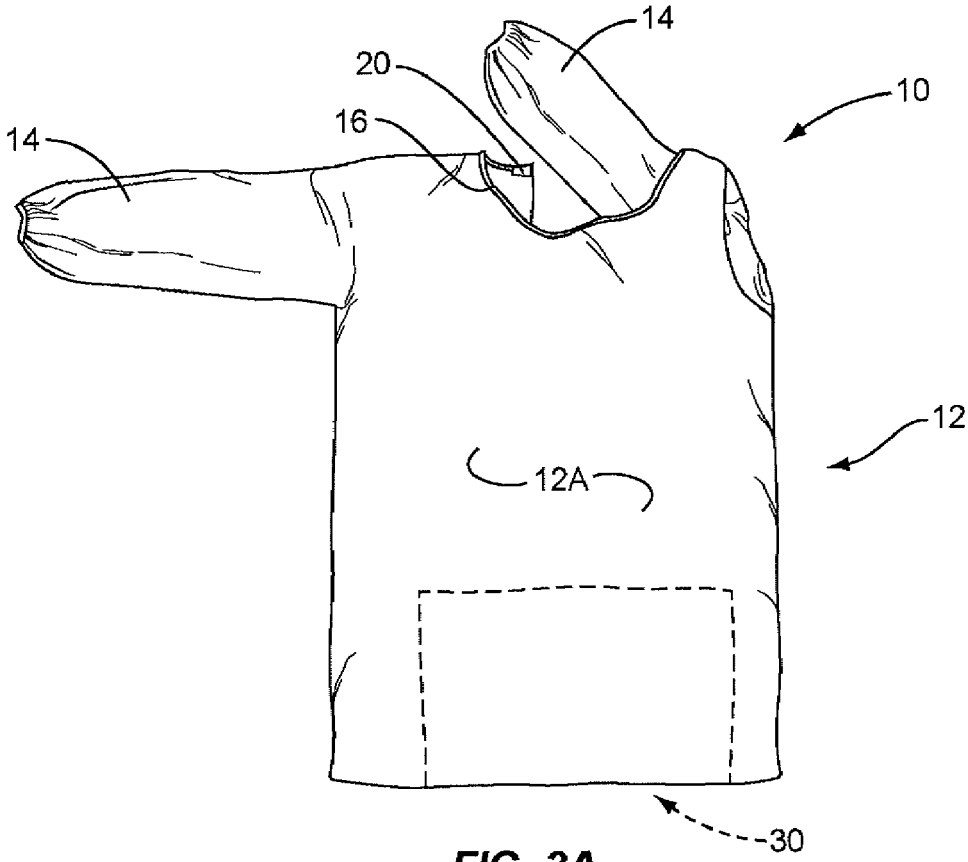
FIG. 3A is a front elevational view of the hospital gown illustrating a portion of a method or process for disposing of the gown.
Figure 3B:
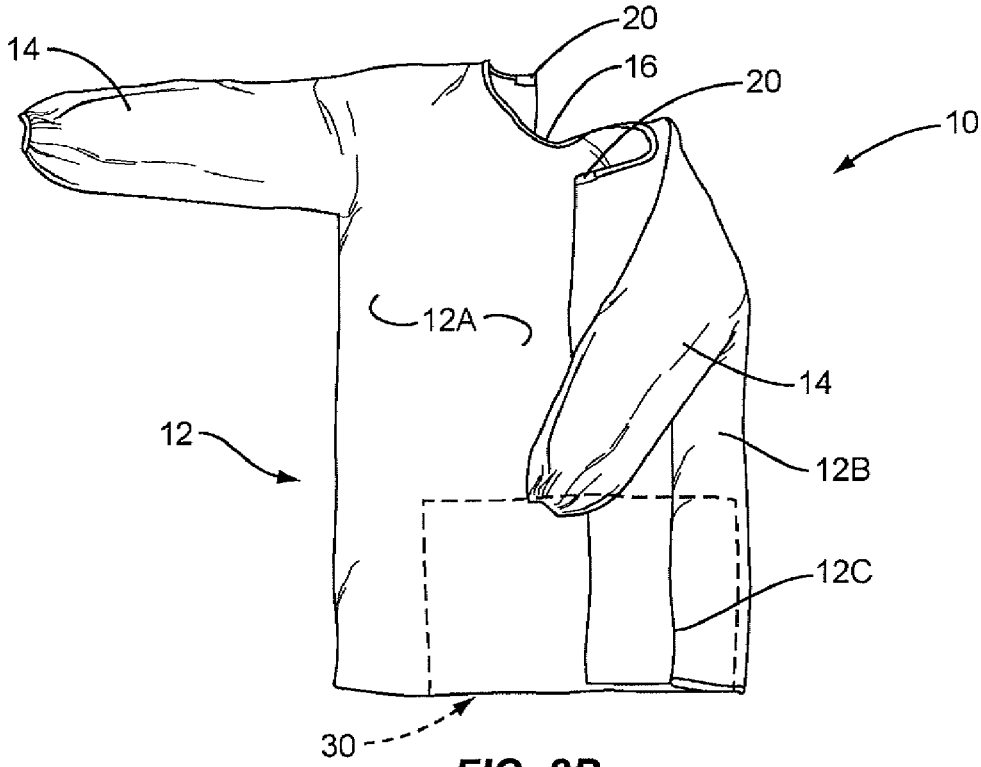
FIG. 3B is a continuation of the method for disposing of the gown and illustrates portions of the gown being positioned to be folded or rolled into a bundle.

FIGS. 3A-3I illustrate how the disposable isolation hospital gown 10 is rolled or folded into a bundle and disposed of by wrapping the bundled gown in the disposable wrapper 30 that forms an integral part of the gown. Starting with FIG. 3A, the left-hand sleeve 14 is turned inside-outward to form the inside-outward left sleeve 14 shown in FIG. 3A. This is typically accomplished by the person wearing the gown simply grasping an inside surface of the sleeve and pulling the arm out of the sleeve. Once the left-hand sleeve 14 has been turned inside-outward, a left portion of the back area 12B can be positioned across the front area 12A as shown in FIG. 3B. Note that the back area 12B that is folded over the front area 12A generally underlies the inside-outward sleeve 14. In order to narrow the width of the gown, a portion of the back area 12B is lapped over another portion and this gives rise to seam or fold 12C shown in FIG. 3B. As seen in FIG. 3B, it is important to appreciate that the portion of the back area 12B shown therein and exposed is the inner surface of the back area. Thus, the person removing the gown and folding or rolling the gown into a bundle can contact the inner surface of the inside-outward sleeve 14 or the inner surface of the back area 12B. This enables the person to avoid touching the outer surface of the main body 12 or even the outer surface of a sleeve 14. The wrapper is wide enough that it can encompass any reasonable size rolled gown.

Figure 3C:
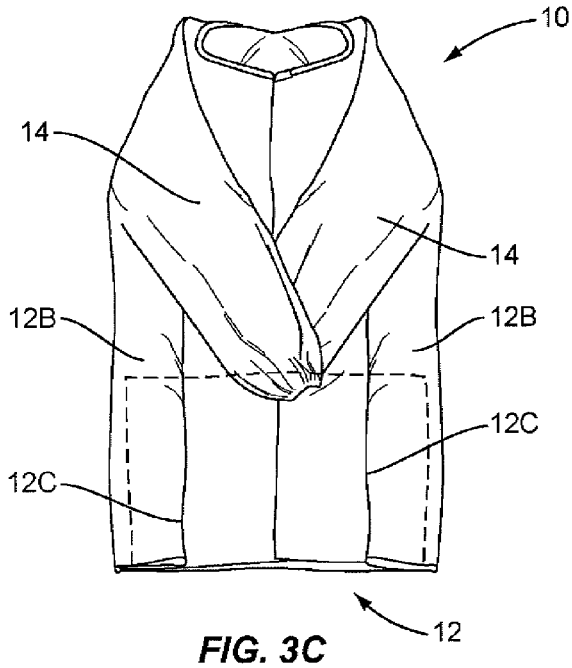
FIG. 3C is a front elevational view of the gown showing other portions of the gown being positioned for subsequent folding or rolling into a bundle.

The method or process described above and shown in FIGS. 3A and 3B with respect to the left side of the gown 10 is repeated for the right side of the gown. This is illustrated in FIG. 3C. As FIG. 3C illustrates, both sleeves 14 have been turned inside-outward and the back area 12B from both sides has been positioned over a portion of the front area 12A. As seen in FIG. 3C, the complete area of the outer surface of 12A has been covered by the back area 12B of the gown. Furthermore, the exposed portion of the back area 12B is the inner surface of the back area and not the outer surface thereof.

Figure 3D:
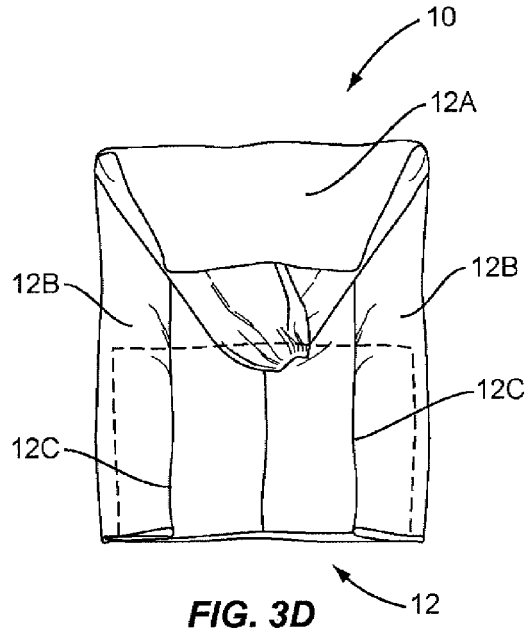
FIG. 3D is a front elevational view and shows the continuing method or process for folding or rolling the gown into a bundle.

After the gown 10 has been placed in the general configuration shown in FIG. 3C, the gown is folded or rolled downwardly from the top. This is illustrated in FIG. 3D. Note in FIG. 3D where a portion of the front area 12A is rolled or folded downwardly over a portion of the inside-outward sleeves 14. The upper portion of the front area 12A exposed in FIG. 3D is the inner surface of the front area.

Figure 3E:
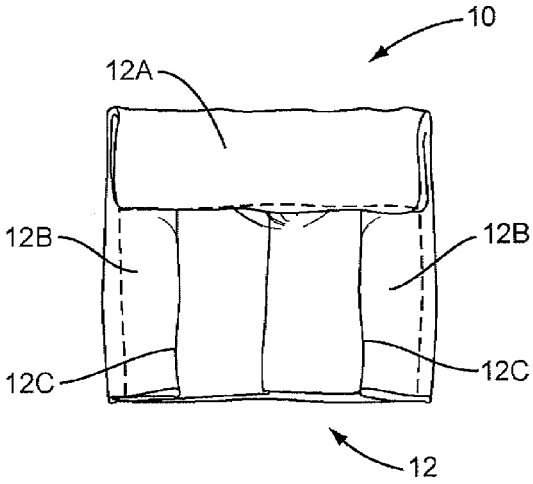
FIG. 3E is an elevational view continuing to show the method or process of folding the gown into a bundle.

The folding or rolling of the gown is continued as shown in FIG. 3E. Again, the upper portion of the gown as viewed in FIG. 3E comprises a portion of a front area 12*a*, but again the upper exposed surface of the front area is the inner surface thereof.

Figure 3F:
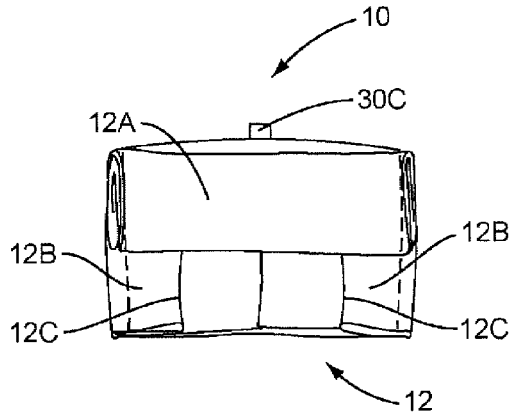
FIG. 3F is an elevational view that shows the continuing method or process of folding the gown into a bundle.

The process continues as illustrated in FIG. 3F. Note that in FIG. 3F, the closing tab 30C formed on the inner surface of the front area 12A is shown.

Figure 3G:
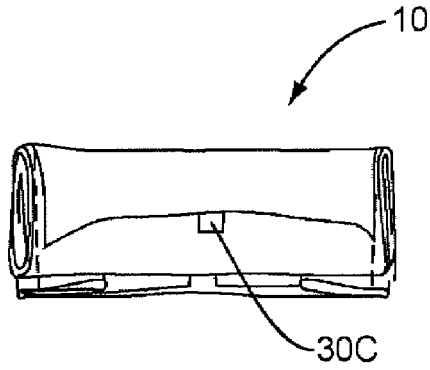
FIG. 3G shows the gown being folded or rolled into a bundle.
Figure 3H:
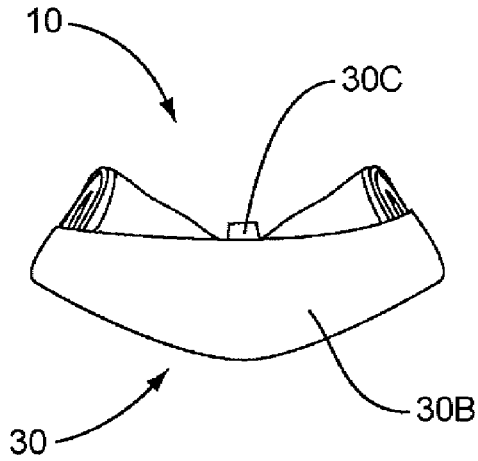
FIG. 3H illustrates the disposable wrapper integral with a gown being reversed and wrapped over the bundled gown.
Figure 3I:
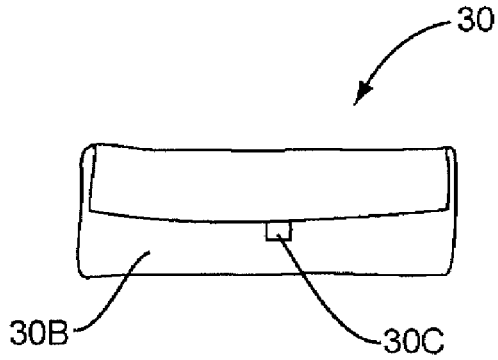
FIG. 3I shows the disposable wrapper enclosing the bundled gown.

Eventually, the gown is folded or rolled to a point where a bundle is formed. The bundled gown is shown in FIG. 3G. In this orientation, the bundled gown 10 overlies the disposable wrapper 30. In order to place the bundled gown into the disposable wrapper 30, the disposable wrapper is turned inside-outward and in the process wraps around the bundled gown as illustrated in FIG. 3H. In this process, the former inner surface 30B of the disposable wrapper 30 becomes the outer surface of the formed pouch or container. That is, by turning the disposable wrapper 30 inside-outward, the wrapper wraps around while the bundled gown is stuffed, pushed or placed into the interior area of the formed pouch. Therefore, the former exterior or outer surface 30A of the disposable wrapper 30 becomes the interior surface of the pouch shown in FIGS. 3H and 3I. The former inner surface 30B of the disposable wrapper 30 now becomes the outer surface or exterior surface of the pouch. Finally, the closing tab 30C, which can be a piece of tape, an adhesive strip or other closing device, is closed down on the exterior surface 30B of the pouch and this containerizes by wrapping the bundled gown.

This wrapper forms an additional line of defense, as it creates a barrier helping to guard against the transmission of possible infectious agents, such as but not limited to, *staphylococcus aureus* and methicillinn resistant *staphylococcus aureus* (MRSA) etc., which can be spread on contact.

To facilitate the folding or rolling of the gown into the bundle, the outer surface of the main body 12 and sleeves 14 could be a different color from the inner surface of the main body and sleeves. In addition, the gown 10 can be provided with indicia that facilitates and makes the folding or rolling of the gown into a bundle easier. That is, indicia or lines can be drawn or provided on the gown to indicate the appropriate position of portions of the gown during various stages of the rolling or folding process.

In the embodiment illustrated, there is one tab 30C for closing the formed pouch or container. It is understood and appreciated that there can be a plurality of tabs and, indeed, there can be provided a closing device formed in the disposable wrapper or formed in conjunction with the gown that will provide a generally airtight seal when the pouch is closed.

In most cases, persons wearing the gown 10 will also have gloves. These gloves can be removed prior to removing and folding the gown 10 into the bundle. In the alternative, the gloves can be removed during the process of removing the sleeves 14 and turning the sleeves inside-outward. It should also be noted that any process of removing the isolation gown that folds or rolls the gown into the wrapper and adheres to hospital protocol (where the wearer does not have contact with the contaminated portion) is acceptable.

It is appreciated by those skilled in the art that the gown 10 can assume various designs and styles. However, the use of the integral disposable wrapper 30 and the general method or process of disposing of the gown will remain the same. The basic method or process of forming the disposable hospital gown into a bundle and containerizing the disposable gown in a disposable wrapper will remain the same.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

The invention claimed is:

1. A method of removing and disposing of a disposable gown wherein the disposable gown comprises a main body having a front area, a back area, and inner and outer surfaces; a pair of sleeves extending from the main body, and a disposable wrapper in the form of sheet material for wrapping and enclosing the disposable gown when the gown assumes a bundled configuration; and wherein the disposable wrapper is secured on the inner surface of the main body about a lower portion of the front area of the main body, such that in a wearing configuration the wrapper forms a panel that is secured about outer portions to the inner surface of the main body and the panel extends across the inner surface of the main body, and wherein the method comprises:

removing the gown from a person;

rolling or folding the removed gown into a bundle to form a bundled gown;

positioning the bundled gown adjacent the wrapper; and engaging the wrapper while holding the bundled gown and pulling the wrapper away from the adjacent inner surface of the main body of the gown and wrapping the wrapper around the entire bundled gown such that one portion of the wrapper overlaps another portion of the wrapper and the entire disposable bundled gown is encircled and enclosed by the overlapping wrapper that is wrapped around the disposable bundled gown.

2. The method of claim 1 wherein rolling or folding the disposable gown into a bundle includes positioning portions of the inner surface of the gown over the outer surface of the gown such that portions of the inner surface are exposed and cover portions of the outer surface of the gown such that the disposable gown can be contacted for the purpose of rolling or folding the gown without contacting the outer surface of the gown.

3. The method of claim 1 further including:

turning the sleeves inside-outward to form inside-outward sleeves;

folding the inside-outward sleeves and a portion of the back area over the outer surface of the front area such that portions of the inside-outward sleeves and the inner surface of the back area are exposed and overlie the front area of the main body; and thereafter folding or rolling the disposable gown into a bundle.

4. The method of claim 1 wherein the disposable wrapper includes a closing tab and the method includes encircling the bundled gowned in the wrapper and utilizing the closing tab to close the wrapper around the enclosed bundled gown.

5. The method of claim 1 wherein the disposable wrapper includes a terminal edge and wherein there is a closing tab that projects from the terminal edge of the disposable wrapper, and where the method includes encircling the bundled gown with the wrapper such that the wrapper wraps around the bundled gown and securing the wrapper in a closed position by securing the closing tab to a portion of the wrapped wrapper.

* * * * *